US010165885B2

(12) United States Patent
Sandybayev

(10) Patent No.: US 10,165,885 B2
(45) Date of Patent: Jan. 1, 2019

(54) STACKABLE TRAY WITH COMPARTMENT

(71) Applicant: Zhomart D. Sandybayev, Atlanta, GA (US)

(72) Inventor: Zhomart D. Sandybayev, Atlanta, GA (US)

( * ) Notice: Subject to any disclaimer, the term of this patent is extended or adjusted under 35 U.S.C. 154(b) by 0 days.

(21) Appl. No.: 15/462,178

(22) Filed: Mar. 17, 2017

(65) Prior Publication Data

US 2017/0273486 A1 Sep. 28, 2017

Related U.S. Application Data

(60) Provisional application No. 62/343,565, filed on May 31, 2016, provisional application No. 62/312,020, filed on Mar. 23, 2016.

(51) Int. Cl.

| | |
|---|---|
| ***A47G 23/06*** | (2006.01) |
| ***B65D 43/16*** | (2006.01) |
| ***B65D 1/36*** | (2006.01) |
| ***B65D 21/02*** | (2006.01) |

(52) U.S. Cl.

CPC ..... *A47G 23/0608* (2013.01); *A47G 23/0633* (2013.01); *B65D 1/36* (2013.01); *B65D 21/0233* (2013.01); *B65D 43/16* (2013.01)

(58) Field of Classification Search

CPC ..... A47G 23/0608; A47G 23/06; B65D 1/36; B65D 21/0233; B65D 43/16

USPC ..... 206/557–567

See application file for complete search history.

(56) References Cited

U.S. PATENT DOCUMENTS

| | | | | | |
|---|---|---|---|---|---|
| 2,808,191 | A * | 10/1957 | Cramer | A47G 23/0608 | 108/26 |
| 2,924,372 | A | 2/1960 | Kirkeby | | |
| 4,927,024 | A * | 5/1990 | Lloyd | A47D 1/008 | 206/562 |
| 5,413,035 | A * | 5/1995 | Fernandez | B60N 3/005 | 100/44 |
| 5,425,455 | A * | 6/1995 | Miller | A47G 23/0608 | 206/562 |
| 5,520,119 | A | 5/1996 | Eisenberg | | |
| 5,833,056 | A * | 11/1998 | Goldman | A47G 23/0641 | 206/199 |
| 5,850,956 | A * | 12/1998 | Hayward, Jr. | A45F 5/00 | 224/270 |
| 5,915,561 | A | 6/1999 | Lorenzana et al. | | |
| RE37,239 | E | 6/2001 | Eisenberg | | |
| 6,311,841 | B1 | 11/2001 | Hodges | | |
| 6,401,927 | B1 * | 6/2002 | Sorensen | A47G 19/06 | 206/216 |
| 6,732,990 | B2 | 5/2004 | Hudson | | |

(Continued)

*Primary Examiner* — Chun Cheung

(74) *Attorney, Agent, or Firm* — Mathew L. Grell; Jeffrey C. Watson; Grell & Watson Patent Attorneys LLC

(57) ABSTRACT

An apparatus and an associated method that includes a lap tray, the lap tray having a flat portion and a raised perimeter edge, wherein the flat portion defines a top surface and a bottom surface, wherein the flat portion defines an aperture. The apparatus further includes a tray compartment operably engaged with the lap tray. The tray compartment has a sidewall and a bottom wall, the sidewall and the bottom wall define, in part, an interior space accessible via the aperture. A lid operably engaged with the tray compartment is configured to enclose the interior space of the tray compartment.

12 Claims, 19 Drawing Sheets

(56) References Cited

U.S. PATENT DOCUMENTS

| | | | | |
|---|---|---|---|---|
| 7,293,695 | B2 | 11/2007 | Stier | |
| 7,562,808 | B1 | 7/2009 | Philips | |
| 7,793,785 | B2 * | 9/2010 | Keffeler | A61J 1/03 206/532 |
| 8,186,530 | B2 | 5/2012 | Bar | |
| 8,215,242 | B2 | 7/2012 | Aguayo | |
| 2005/0205571 | A1 | 9/2005 | Carpenter | |
| 2008/0121552 | A1 | 5/2008 | Anderson et al. | |
| 2008/0128313 | A1 | 6/2008 | Anderson et al. | |
| 2009/0020450 | A1 * | 1/2009 | Heneghan | B60N 3/002 206/567 |
| 2009/0200197 | A1 | 8/2009 | Kovacevich et al. | |
| 2009/0223418 | A1 * | 9/2009 | Ferrara | A45F 4/06 108/14 |
| 2010/0044265 | A1 | 2/2010 | Ragsdale et al. | |
| 2016/0106248 | A1 | 4/2016 | Petersen et al. | |

* cited by examiner

STACKABLE TRAY WITH COMPARTMENT

CROSS-REFERENCE TO RELATED APPLICATIONS

To the full extent permitted by law, the present U.S. Non-provisional patent application hereby claims priority to and the full benefit of U.S. Provisional Patent Application No. 62/312,020, filed Mar. 23, 2016, and U.S. Provisional Patent Application No. 62/343,565, filed May 31, 2016, the disclosures of which are each incorporated herein by reference in their entirety.

BACKGROUND

Field of the Disclosure

The present disclosure relates generally to a tray apparatus for use during meal times and more specifically, to a tray apparatus that includes a tray compartment, which may provide for securing the tray apparatus during use and for storing items before, during, and/or after use of the tray apparatus.

Description of Related Art

Food trays and other related carriers for use during meal times are known in the prior art. In some instances, trays may include a plurality of demarcated regions to house certain food items, trash, drink cups, and/or the like. Some trays may include a drink compartment configured to retain a drink cup therein, but such trays also include a flat bottom surface such that a majority of the drink cup surface is exposed when the drink cup is stored within the drink compartment. Further, food trays often do not include lids for enclosing a compartment for waste retention during meals. Unsightly food and/or paper waste may clutter the lap tray while in use and may cause additional and unwanted mess. Therefore, it is readily apparent that there is a recognized unmet need for securable a lap tray with a tray compartment that is grippable by a user's legs to secure the lap tray during a meal, especially when no table surface is available such as during sporting events and other public gatherings. Additionally, there is an unmet need for a tray apparatus that includes a lid for enclosing the tray compartment to separate food items and/or waste during meal times.

BRIEF SUMMARY

Example implementations of the present disclosure are directed to a tray apparatus for use during meal times. In one aspect, the tray apparatus includes a lap tray having a flat portion and a raised perimeter edge. The flat portion may define a top surface and a bottom surface and may further define an aperture. The tray apparatus may further include a tray compartment operably engaged with the lap tray. The tray compartment may further include a lid operably engaged with the tray compartment. The lid may be configured to enclose the interior space of the tray compartment.

According to one example implementation of the present disclosure, the lid may be configured to hingedly connect to an edge of the sidewall of the tray compartment. In some example implementations, the lid may further include a pull tab. In yet another example implementation, the lid may define a compartment access element. The compartment access element may be configured to provide for access to the interior space of the tray compartment when the lid encloses the interior space of the tray compartment. In some aspects, the lid may be configured to operably engage the lap tray in a snap fit engagement.

According to another example implementation of the present disclosure, the tray compartment may be configured to operably engage the lap tray in a snap fit engagement. In some aspects, the tray compartment may further include a plurality of tray compartment fold lines. The tray compartment may be configured to fold along the tray compartment fold lines to form the sidewall and the bottom wall of the tray compartment.

In another example implementation of the present disclosure, the lap tray may further include a plurality of lap tray fold lines. The lap tray may be configured to fold along the lap tray fold lines to form the flat portion and the raised perimeter edge of the lap tray. The lap tray and the tray compartment may be configured to transform from a stored configuration to an operating configuration. For example, the lap tray and the tray compartment may both be configured as flat planar surfaces and/or members when disposed in the stored configuration. In one exemplary aspect of the present disclosure, the lap tray and the tray compartment of a first tray apparatus may be configured to operably engage a lap tray and a tray compartment of a second tray apparatus while the first and second tray apparatuses are disposed in the stored configuration. Additionally or alternatively, the lap tray and the tray compartment of a first tray apparatus may be configured to operably engage a lap tray and a tray compartment of a second tray apparatus while the first and second tray apparatuses are disposed in the operating configuration.

According to one aspect, the tray compartment may be integrally formed with the lap tray. Additionally, the sidewall of the tray compartment may extend downwardly from the top surface of the lap tray. Further, the sidewall of the tray compartment may be configured to provide for a user to grasp the sidewall of the tray compartment between the legs of the user when the user is disposed in a seated position and/or when a portion of the legs of the user grasping the sidewall of the tray compartment are disposed substantially horizontally. In some aspects, the sidewall of the tray compartment may extend a distance less than the depth of the legs of the user when the user is disposed in the seated position and/or when a portion of the legs of the user grasping the sidewall of the tray compartment are disposed substantially horizontally.

According to one example aspect of the present disclosure, the tray apparatus may further include a tray liner that includes at least one tray liner securing element configured to removeably engage and/or secure the tray liner to the lap tray and/or tray compartment.

In yet another exemplary aspect, a tray apparatus may include a lap tray having a flat portion and a raised perimeter edge. The flat portion may define a top surface and a bottom surface, and may further define an aperture. The tray apparatus may include a tray liner configured to operably engage the lap tray. The tray liner may define a tray compartment configured to extend through the aperture defined by the flat portion of the lap tray. Additionally, the tray liner may include a pair of tray liner securing elements configured to reciprocally engage one another and releasably secure the tray liner in the operating configuration.

In some example aspects, the tray liner may define a flat tray liner portion configured to operably engage the top surface of the lap tray. Additionally, the tray liner may include a lid hingedly attached to the flat tray liner portion. The lid may be configured to enclose an interior space defined by the tray compartment when operably engaged with the flat tray liner portion.

According to some aspects, the tray liner may include a material configured to transform the tray liner between a stored configuration and an operating configuration. In one aspect, the tray liner may be configured as a substantially flat planar member when disposed in the stored configuration. In one example implementation of the present disclosure, the tray liner may include a polymer material. According to one aspect, the tray liner may be configured as a three-dimensional member when disposed in the operating configuration. Additionally or alternatively, the tray compartment may extend downwardly from the flat tray liner portion when the tray liner is disposed in the operating configuration.

According to one example implementation of the present disclosure, a method for using a tray apparatus may include transforming a lap tray between a stored configuration and an operating configuration. The lap tray may be configured as a substantially flat planar member when disposed in the stored configuration. In some aspects, the lap tray may include a flat portion and a raised perimeter edge when the lap tray is disposed in the operating configuration. According to one aspect, the flat portion may define a top surface and a bottom surface. Additionally or alternatively, the flat portion may define an aperture.

In some example implementations, the method may further include transforming a tray compartment between a stored configuration and an operating configuration. The tray compartment may be configured as a substantially flat planar member when disposed in the stored configuration. According to one aspect, the tray compartment may include a sidewall and a bottom wall operably engaged with one another when the tray compartment is disposed in the operating configuration.

According to another example aspect of the present disclosure, the method may further include operably engaging the tray compartment with the lap tray. In some aspects, operably engaging the tray compartment with the lap tray may further include inserting the tray compartment through the aperture defined by the lap tray such that the sidewall and the bottom wall of the tray compartment define, in part, an interior space accessible via the aperture when the lap tray and the tray compartment are disposed in the operating configuration.

The features, functions and advantages discussed herein may be achieved independently in various example implementations or may be combined in yet other example implementations further details of which may be seen with reference to the following description and drawings.

BRIEF DESCRIPTION OF THE DRAWING(S)

Having thus described example implementations of the disclosure in general terms, reference will now be made to the accompanying drawings, which are not necessarily drawn to scale, and wherein:

DETAILED DESCRIPTION

Figure 1:
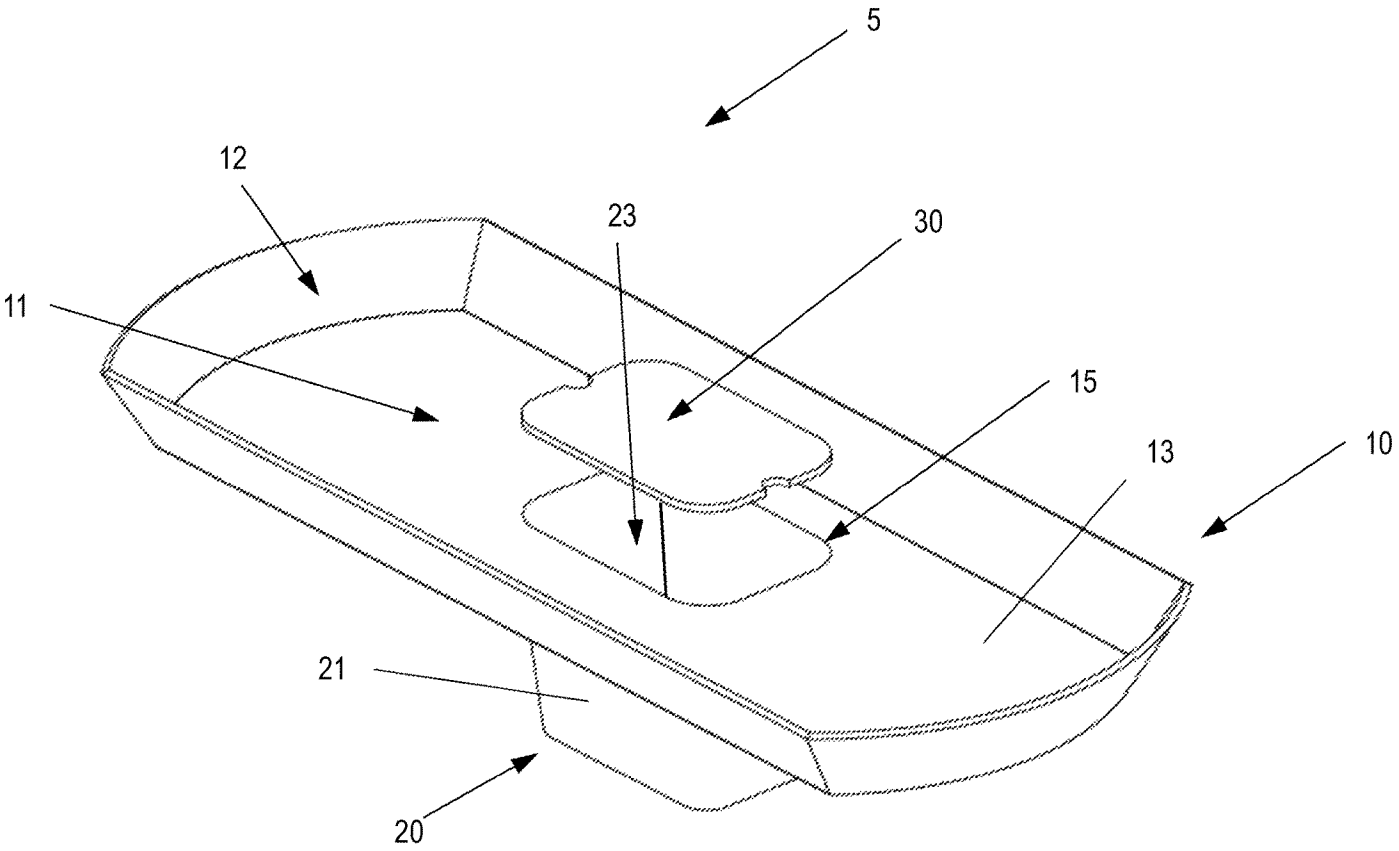
FIG. 1 illustrates a top perspective view of a tray apparatus according to one example implementation of the present disclosure.

Some implementations of the present disclosure will now be described more fully hereinafter with reference to the accompanying drawings, in which some, but not all implementations of the disclosure are shown. Indeed, various implementations of the disclosure may be expressed in many different forms and should not be construed as limited to the implementations set forth herein; rather, these exemplary implementations are provided so that this disclosure will be thorough and complete, and will fully convey the scope of the disclosure to those skilled in the art. As used herein, the term "and/or" and the "/" symbol includes any and all combinations of one or more of the associated listed items. Further, unless otherwise indicated, something being described as being a first, second or the like should not be construed to imply a particular order. It should be understood that the terms first, second, etc. may be used herein to describe various steps, calculations, positions and/or the like, these steps, calculations or positions should not be limited to these terms. These terms are only used to distinguish one operation, calculation, or position from another. For example, a first position may be termed a second position, and, similarly, a second step may be termed a first step, without departing from the scope of this disclosure. Additionally, something may be described as being above something else (unless otherwise indicated) may instead be below, and vice versa; and similarly, something described as being to the left of something else may instead be to the right, and vice versa. As used in the specification, and in the appended claims, the singular forms "a", "an", "the", include plural referents unless the context clearly dictates otherwise. Like reference numerals refer to like elements throughout.

Figure 2:
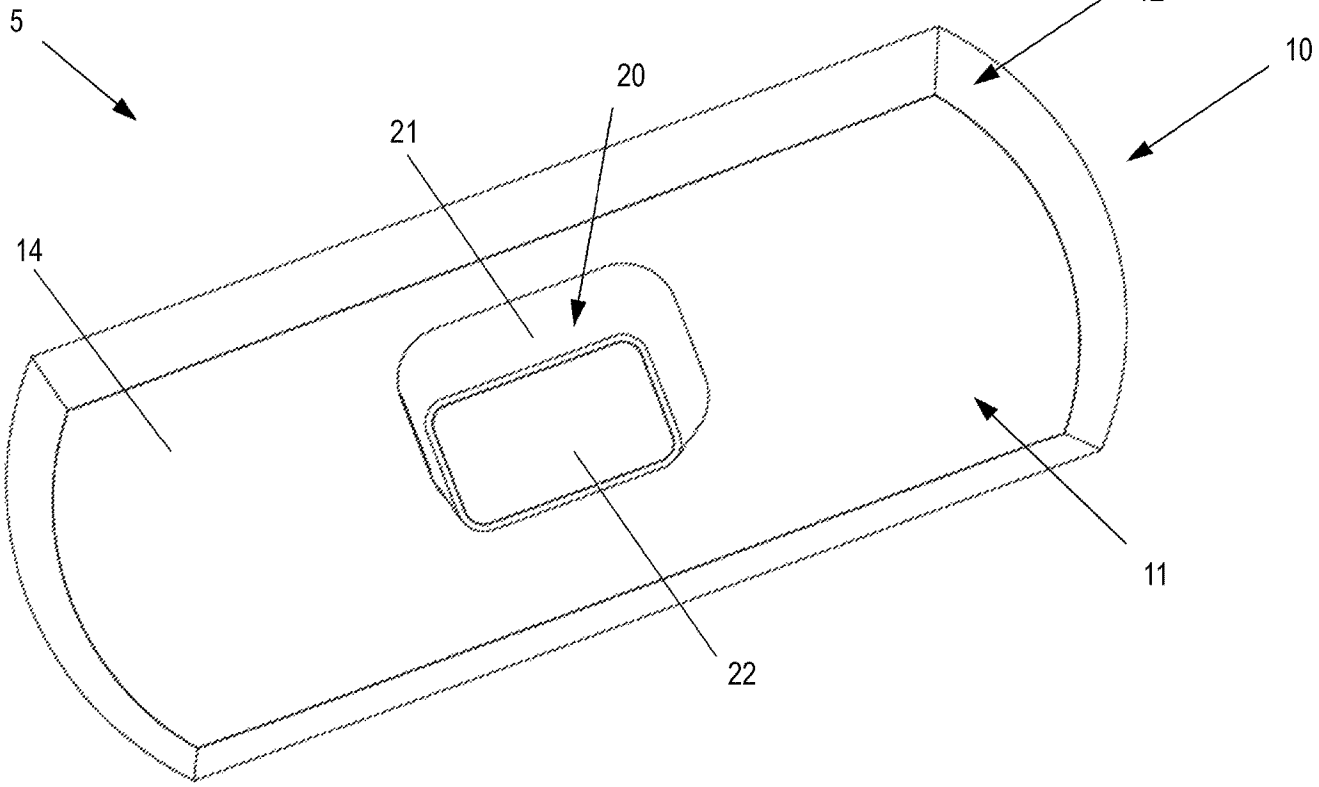
FIG. 2 illustrates a bottom perspective view of a tray apparatus according to one example implementation of the present disclosure.

Implementations of the present disclosure provide for a tray apparatus for use during meal times. As shown in FIG. 1, a tray apparatus 5 includes a lap tray 10 and a tray compartment 20. Additionally, the tray apparatus 5 includes a lid 30 operably engaged with the tray compartment 20. In some aspects, the lap tray 10 includes a flat portion 11 and a raised perimeter edge 12. As shown in FIGS. 1 and 2, the flat portion 11 defines a top surface 13 and a bottom surface 14. Additionally, the flat portion 11 may define an aperture 15 that extends through the flat portion 11 of the lap tray 10. In some aspects, the raised perimeter edge 12 may be configured to retain items on the top surface 13 of the flat portion 11 of the lap tray 10 during use. For example, the raised perimeter edge 12 may be configured to retain food items being consumed on the top surface 13.

Figure 10:
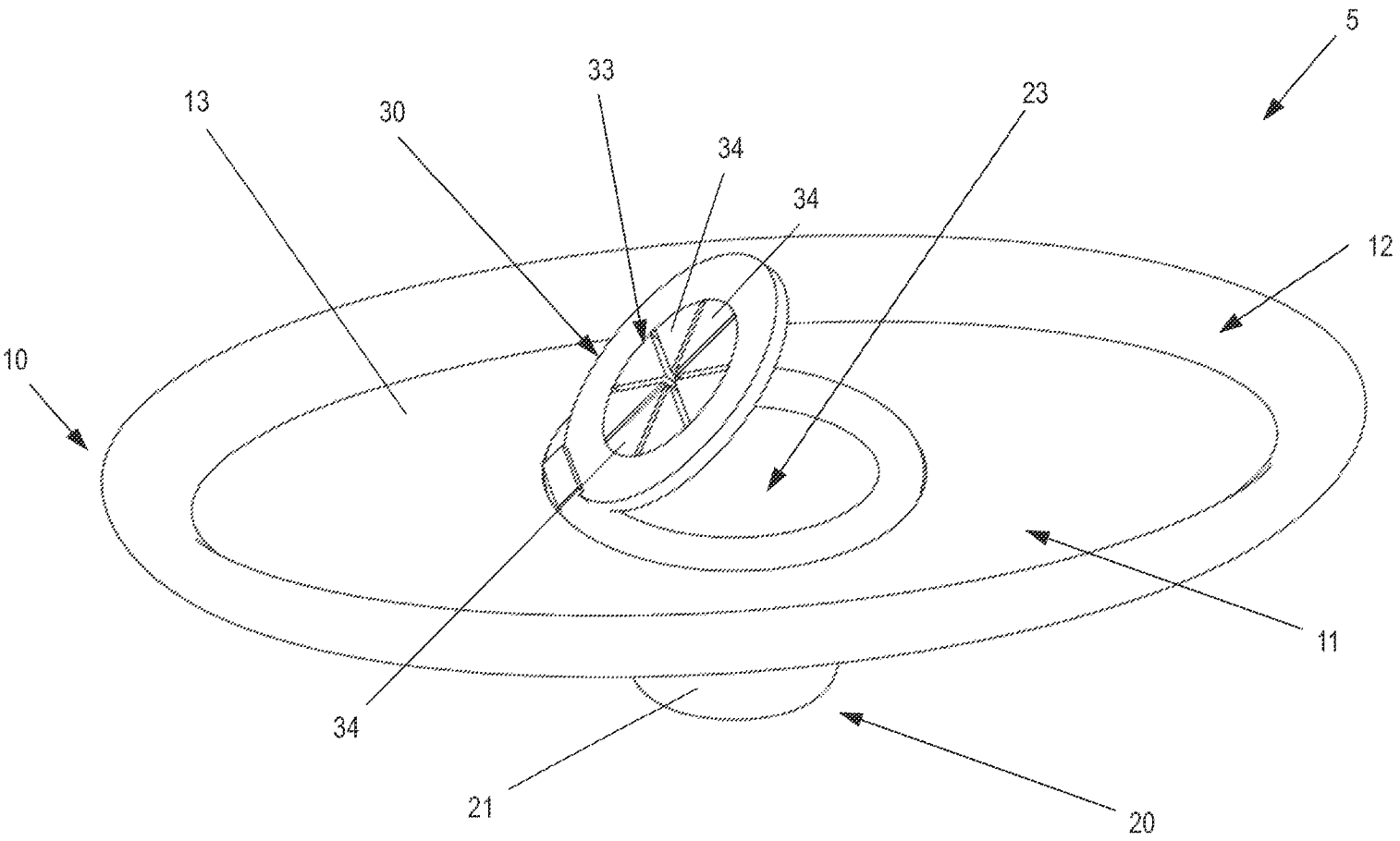
FIG. 10 illustrates a top perspective view of a tray apparatus according to one example implementation of the present disclosure.
Figure 11:
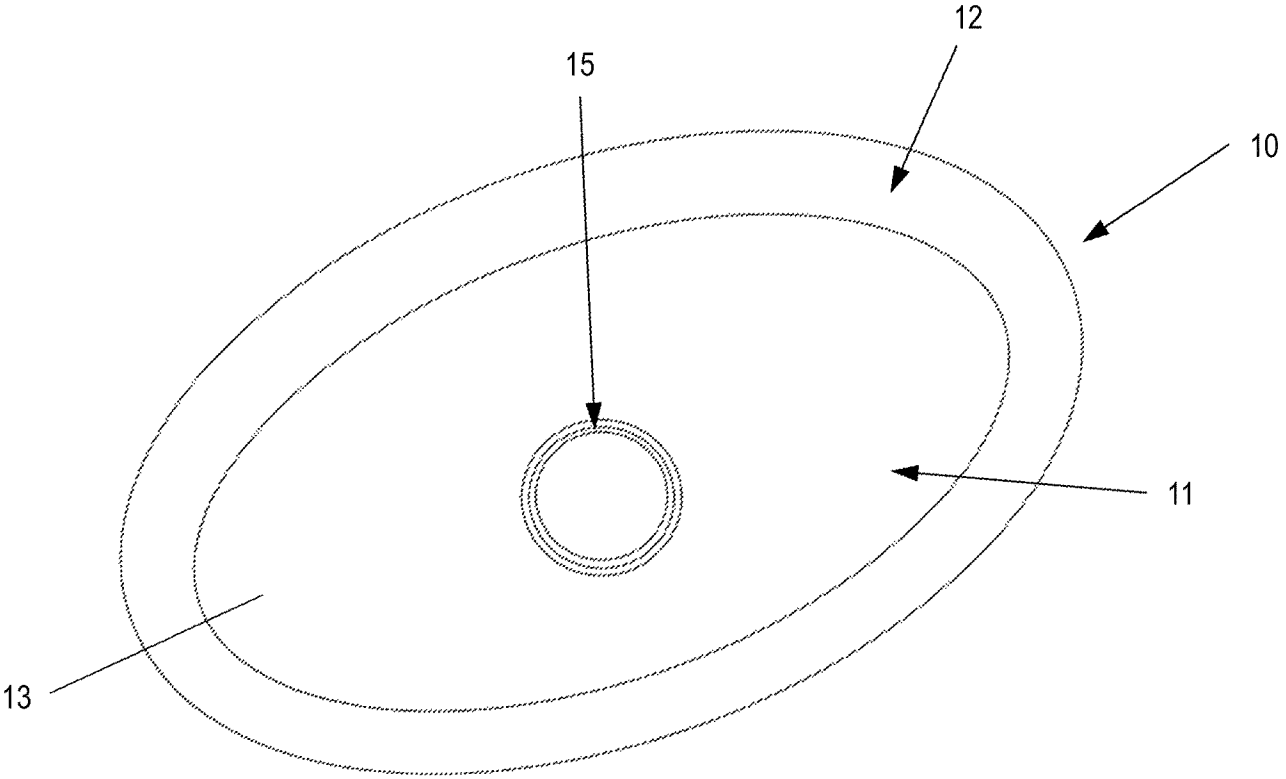
FIG. 11 illustrates a top view of a lap tray according to one example implementation of the present disclosure.
Figure 12:
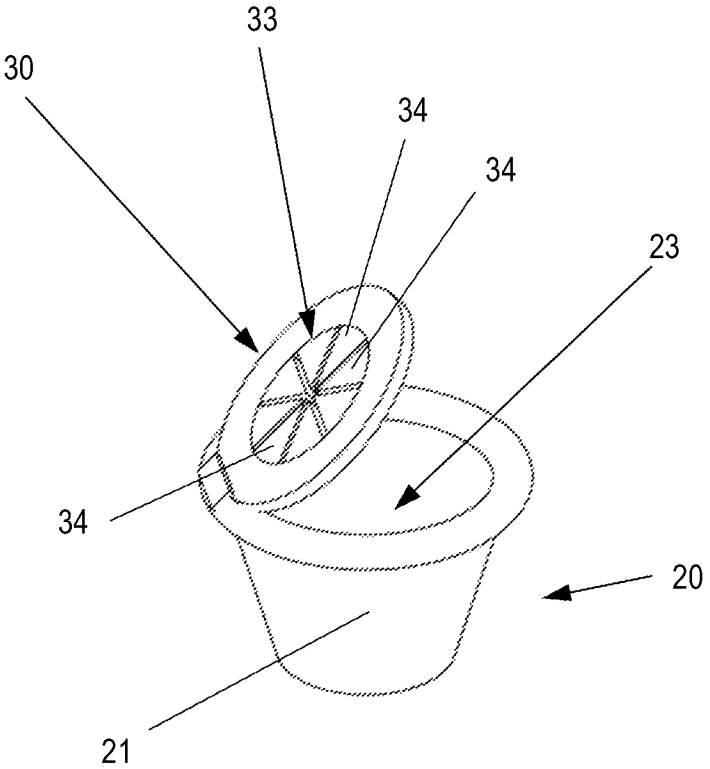
FIG. 12 illustrates a top perspective view of a tray compartment of a tray apparatus according to one example implementation of the present disclosure.

In some aspects, the tray compartment 20 may be operably engaged with the lap tray 10. In particular, the tray compartment 20 may be securely engaged with the lap tray 10 to form the tray apparatus 5, as shown in FIGS. 1 and 2. For example, the tray compartment 20 may be configured to removably attachable to the lap tray 10. According to some aspects, the tray compartment 20 may be integrally formed with the lap tray 10, as shown in FIG. 10. In yet another example aspect, the tray compartment 20 may be configured to operably engage the lap tray 10 in a snap fit engagement, as shown in FIGS. 11 and 12. For example, in one aspect, the lap tray 10 and the tray compartment 20 may include a semi-rigid material such as, for example, a plastic material, paper, cardboard, fiber board, or the like, so as to retain a desired shape. In yet another aspect, the tray compartment 20 may be securely affixed to the lap tray 10 upon the tray compartment 20 being manipulated from a stored configuration to an operating configuration. For example, once the tray compartment 20 is disposed in the operating configuration, the tray compartment 20 may be temporarily and/or securely attached to the lap tray 10 with an adhesive, glue, tape, and/or any other suitable adhesive.

Referring to FIG. 2, the tray compartment 20 may include a sidewall 21 and a bottom wall 22. According to some aspects, the sidewall 21 and the bottom wall 22 of the tray compartment 20 may define, in part, an interior space 23 that is accessible via the aperture 15 defined by the flat portion 11 of the lap tray 10 when the tray compartment 20 is operably engaged with the lap tray 10. As appreciated by one skilled in the art, the tray compartment 20 may include any number of sidewalls 21 that are suitably shaped such that the tray compartment 20 may be disposed between the legs, thighs, knees of a user when disposed in a seated position. For example, the sidewalls 21 of the tray compartment 20 may extend downwardly from the flat portion 11 of the lap tray 10 when the tray compartment 20 is operably engaged with the lap tray 10.

According to some aspects, the sidewalls 21 may extend from the lap tray 10 in a direction opposed to the top surface 13 of the flat portion 11 of the lap tray 10. As previously mentioned, the sidewalls 21 may be configured so as to provide for a user to engage at least one sidewall 21 of the tray compartment 20 between the legs of the user when the user is disposed in a seated position and/or any position where the portion of the legs of the user engaging the at least one sidewall 21 are oriented along a horizontal plane substantially parallel with the flat portion 11 of the lap tray 10. In another aspect, the sidewalls 21 may be concave so as to reciprocally engage the portion of the legs of the user engaging the concave shaped sidewall. According to another example aspect, the sidewall 21 of the tray compartment 20 may be configured to not extend a distance greater than the depth of the portion of the legs of the user when the user is engaging the at least one sidewall. Additionally or alternatively, the sidewall 21 of the tray compartment 20 may be configured such that the distance between the bottom wall 22 of the corresponding tray compartment 20 and the bottom surface 14 of the flat portion 11 of the lap tray 10 is not greater than the depth of the user portion of the legs of the user when the user is engaging the at least one sidewall.

Figure 3:
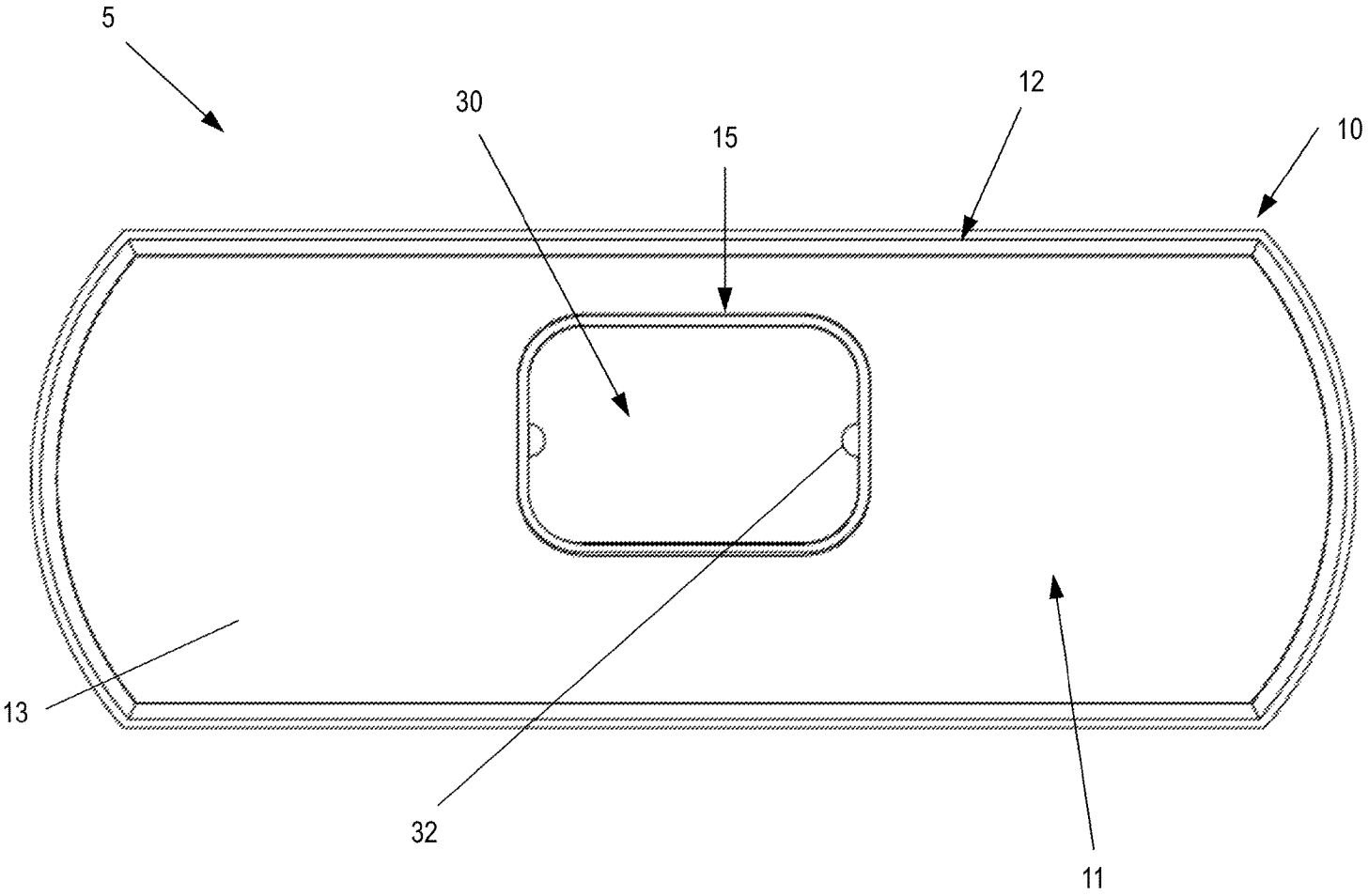
FIG. 3 illustrates a top view of a tray apparatus according to one example implementation of the present disclosure.

Referring to FIG. 1, the interior space 23 defined by the sidewall 21 and the bottom wall 22 of the tray compartment 20 may be configured to receive any number of items commonly used during meals including, for example, drink cups, cans, trash, food waste, and/or the like. In this regard, the lap tray 10 may further include a lid 30 operably engaged with the tray compartment 20. For example, the lid 30 may be configured to enclose the interior space 23 when the lid 30 is operably engaged with the tray compartment 20 so as to segregate waste products from food items still being consumed that are disposed on the flat portion 11 of the lap tray 10. According to some aspects, when operably engaged with the tray compartment 20, the lid 30 may further be configured to form a coplanar surface with the top surface 13 of the lap tray 10, as shown in FIG. 3, so as to provide additional surface area for use while consuming food items.

Figure 4:
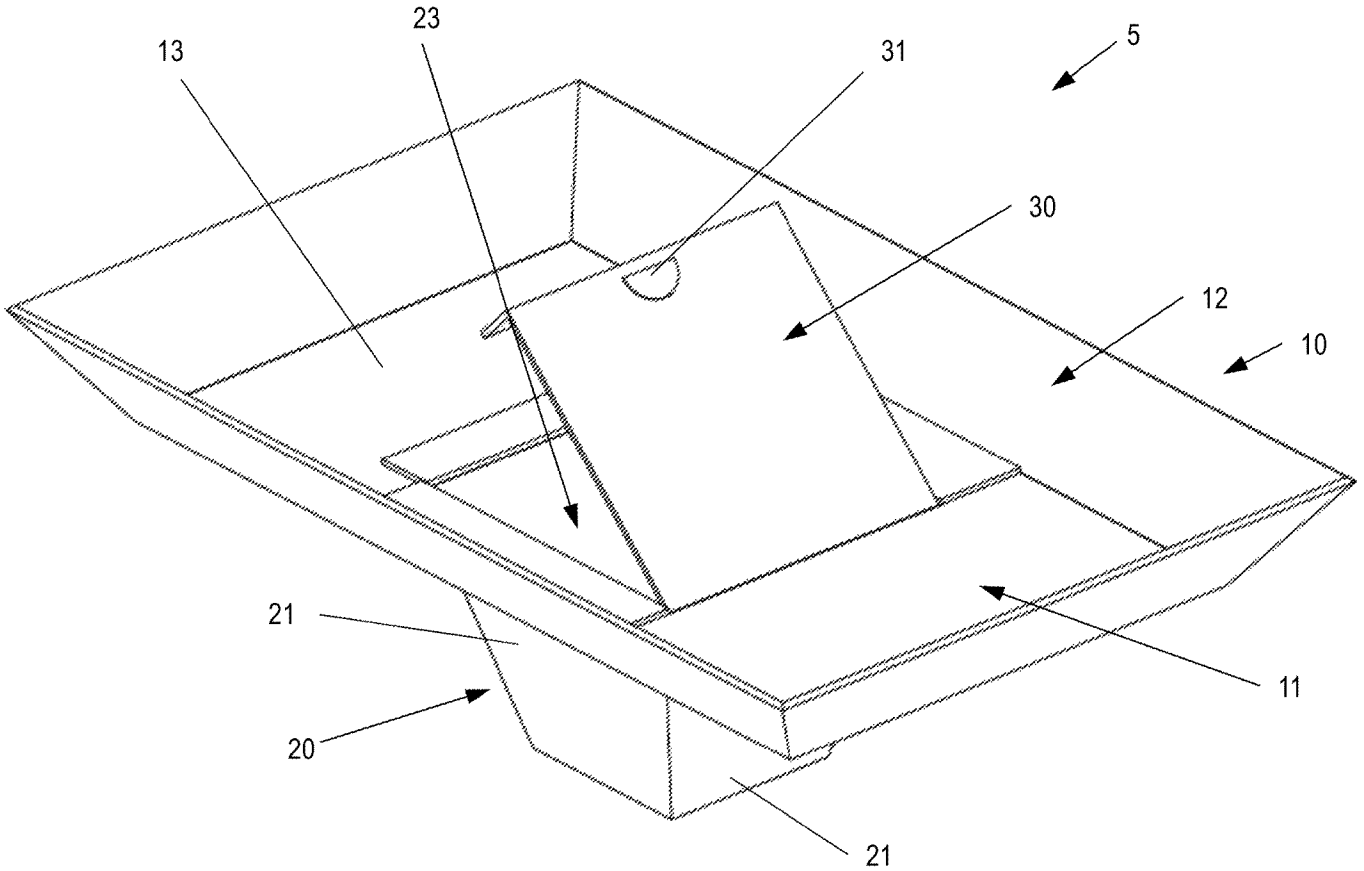
FIG. 4 illustrates a top perspective view of a tray apparatus according to one example implementation of the present disclosure.
Figure 5:
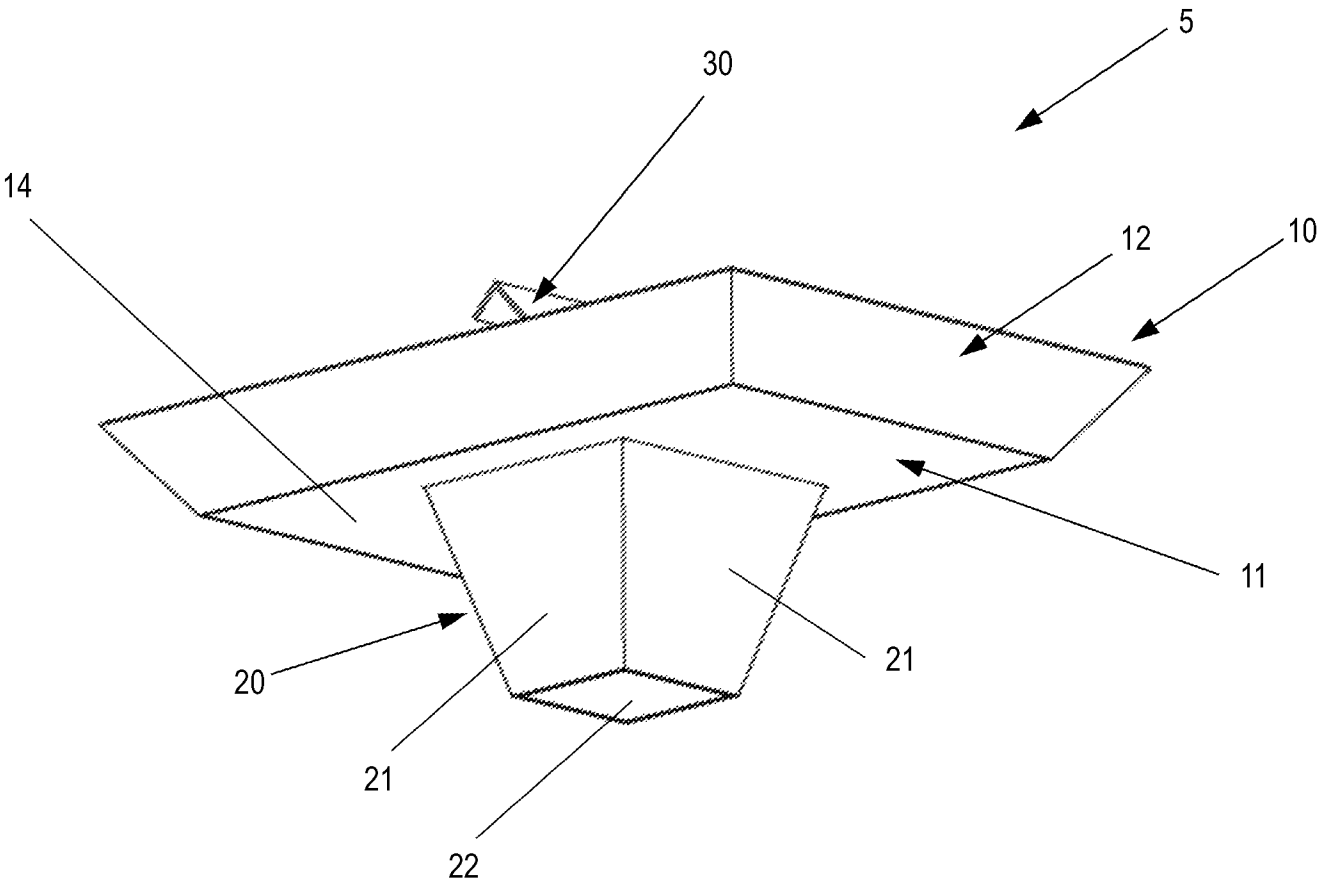
FIG. 5 illustrates a bottom perspective view of a tray apparatus according to one example implementation of the present disclosure.

FIG. 4 illustrates one aspect of the present disclosure which includes a lid 30 configured to be hingedly connected to an edge of the sidewall 21 of the tray compartment 20. For example, as shown in FIG. 4, the lid 30 may be integrally formed with a sidewall 21 of the tray compartment 20 with a tray compartment hinge fold line 25 demarcating the lid 30 from the sidewall 21. As discussed herein, the tray compartment 20 may include a plurality of tray compartment fold lines 24 configured to provide for ease of shaping and/or manipulating the tray compartment 20 from a stored configuration to an operating configuration. In another example aspect, the lid 30 may be operably engaged with the tray compartment 20 using any suitable hinged linkage therebetween that provides for moving the lid 30 from an open position, as shown in FIG. 12, to a closed position (not shown). In yet another aspect of the present disclosure, the lid 30 may be configured to operably engage the tray compartment 20 in a snap fit engagement, friction fit engagement, or any suitable reciprocal engagement which provides for the lid 30 enclosing the interior space 23 of the tray compartment 20.

Figure 6:
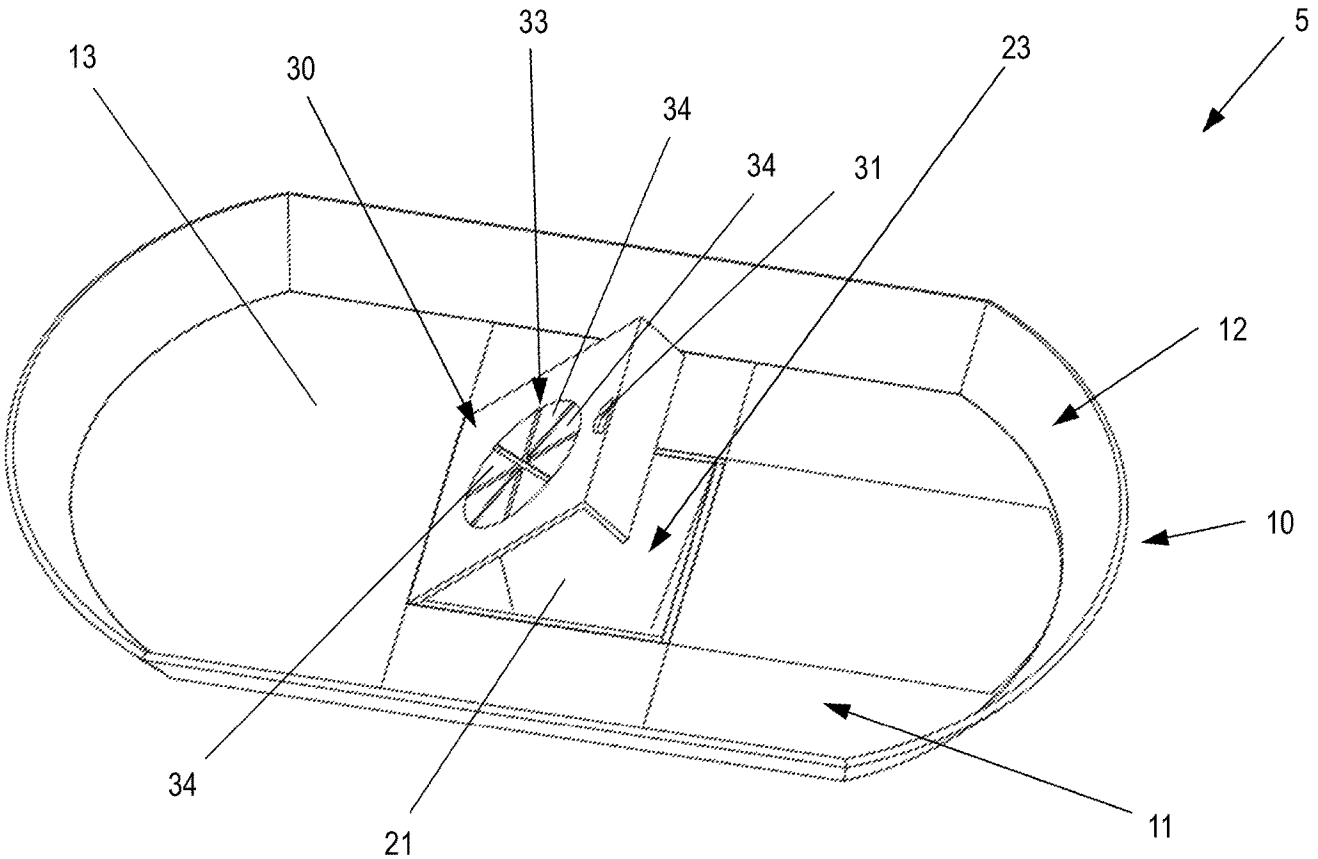
FIG. 6 illustrates a top perspective view of a tray apparatus according to one example implementation of the present disclosure.
Figure 7:
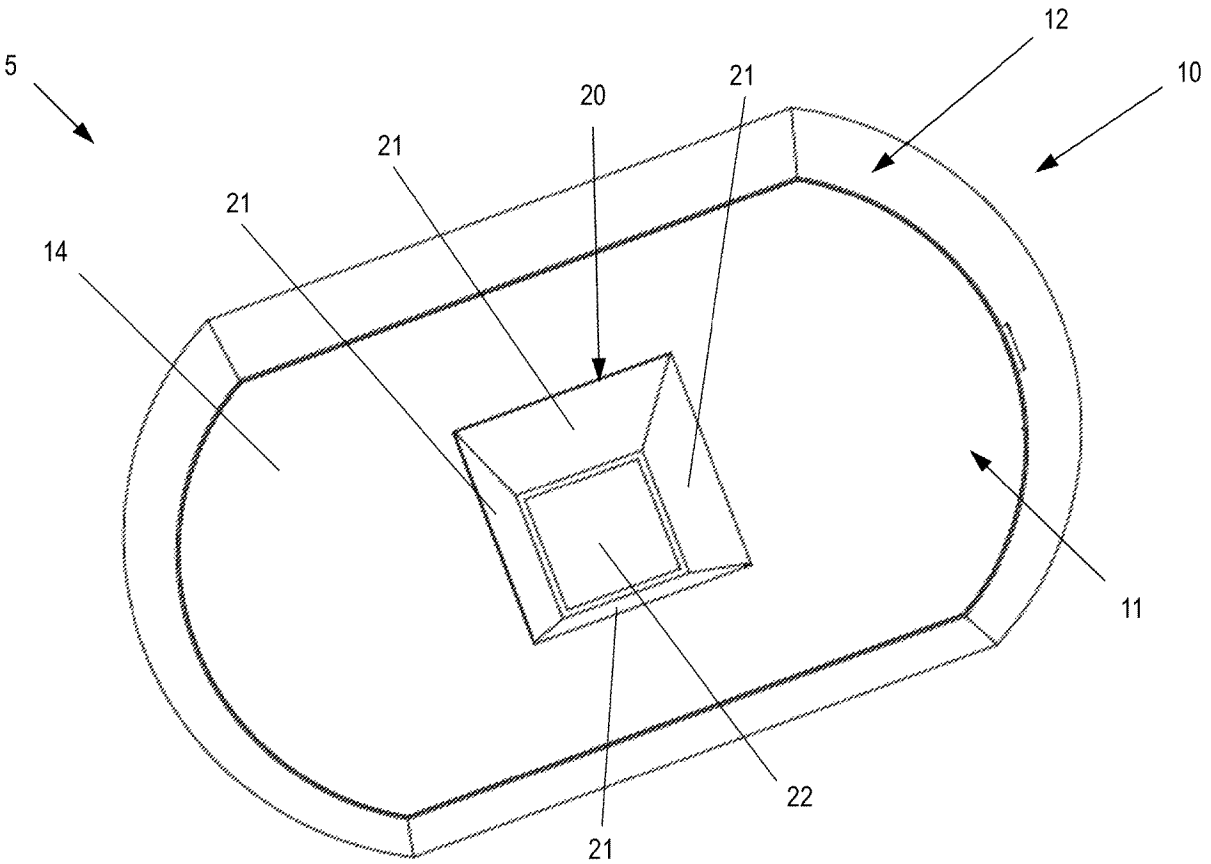
FIG. 7 illustrates a bottom view of a tray apparatus according to one example implementation of the present disclosure.

Returning to FIG. 4, the lid 30 may further include a pull tab 31 configured to facilitate moving the lid 30 between an open position and a closed position. For example, the pull tab 31 may be configured to engage and/or disengage the lid 30 with the tray compartment. According to another aspect, the lid 30 may include at least one edge guide 32 configured to facilitate moving the lid 30 between an open position, as shown in FIG. 1, and a closed position, as shown in FIG. 3. In some aspects, the lid 30 may further define a compartment access element 33 configured to provide access to the interior space 23 of the tray compartment 20. For example, the compartment access element 33 may be configured to provide the lid with a variably sized opening such that a user may engage the compartment access element 33 to gain access to the interior space 23 of the tray compartment 20 when the lid 30 is operably engaged with the tray compartment 20 and/or encloses the interior space 23 of the tray compartment 20. As shown in FIG. 6, a compartment access element 33 may include a plurality of moveable fingers 34 that provide access to the interior space 23 of the tray compartment 20. Additionally or alternatively, the compartment access element 33 may be further configured to secure an item (e.g., a drink cup) inserted therethrough such that the item is securely positioned within the interior space 23 of the tray compartment 20.

Figure 9:
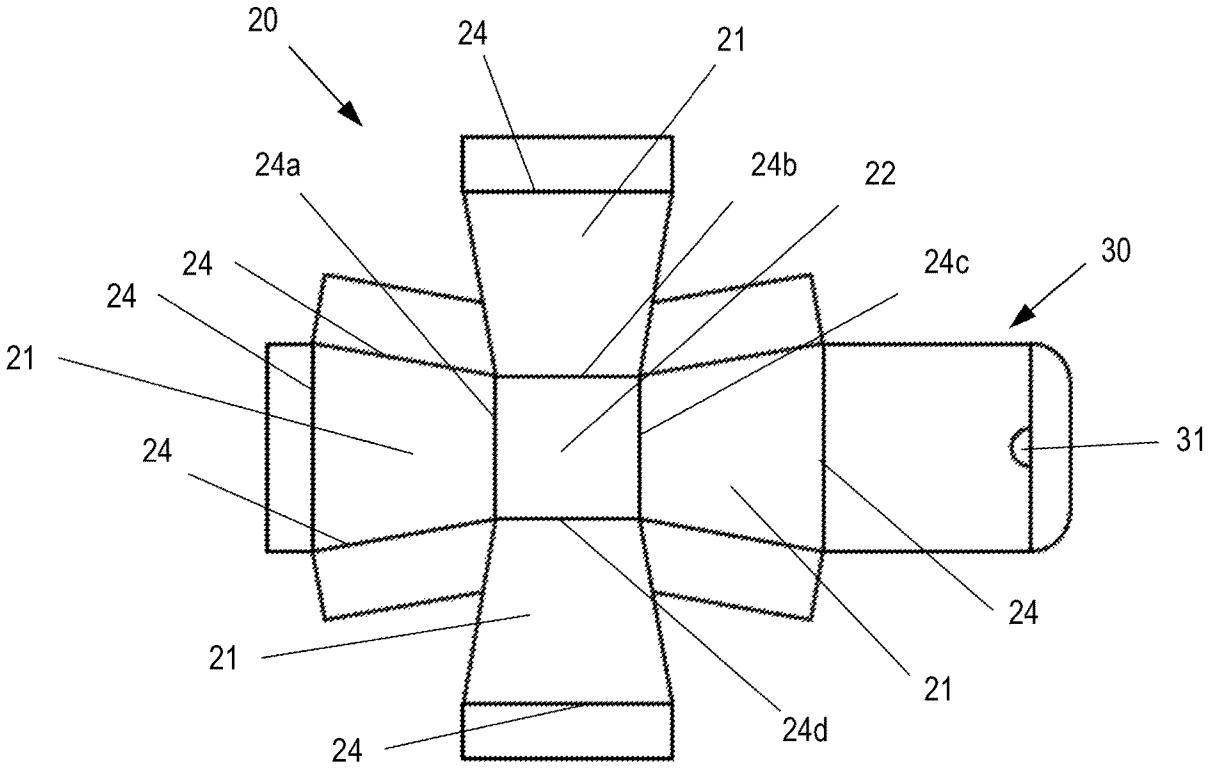
FIG. 9 illustrates a top view of a tray compartment of a tray apparatus disposed in a stored configuration according to one example implementation of the present disclosure.

As previously mentioned herein, the tray compartment 20 may include a plurality of tray compartment fold lines 24 configured to provide for transforming and/or moving the tray compartment 20 between a stored configuration and an operating configuration. As shown in FIG. 9, the tray compartment 20 may include a plurality of tray compartment fold lines 24*a*, 24*b*, 24*c*, 24*d* that demarcate the bottom wall 22 and the sidewall 21 of the tray compartment 20. Additionally or alternatively, the tray compartment 20 is configured to fold along the tray compartment fold lines 24*a*, 24*b*, 24*c*, 24*d* to form the sidewall 21 and the bottom wall 22 of the tray compartment 20. For example, while disposed in the stored configuration, the sidewall 21 and the bottom wall 22 of the tray compartment 20 are configured as a flat planar surface. A user may then fold the tray compartment 20 along the tray compartment fold lines 24*a*, 24*b*, 24*c*, 24*d* to form the bottom wall 22 of the tray compartment 20. Additionally or alternatively, the tray compartment 20 may include additional tray compartment fold lines 24 configured to form the sidewall 21 and/or a plurality of sidewalls 21 configured to operably engage one another. For example, the plurality of sidewalls 21 may be securely affixed to one another with tape, glue, and/or any other suitable adhesive.

Figure 8:
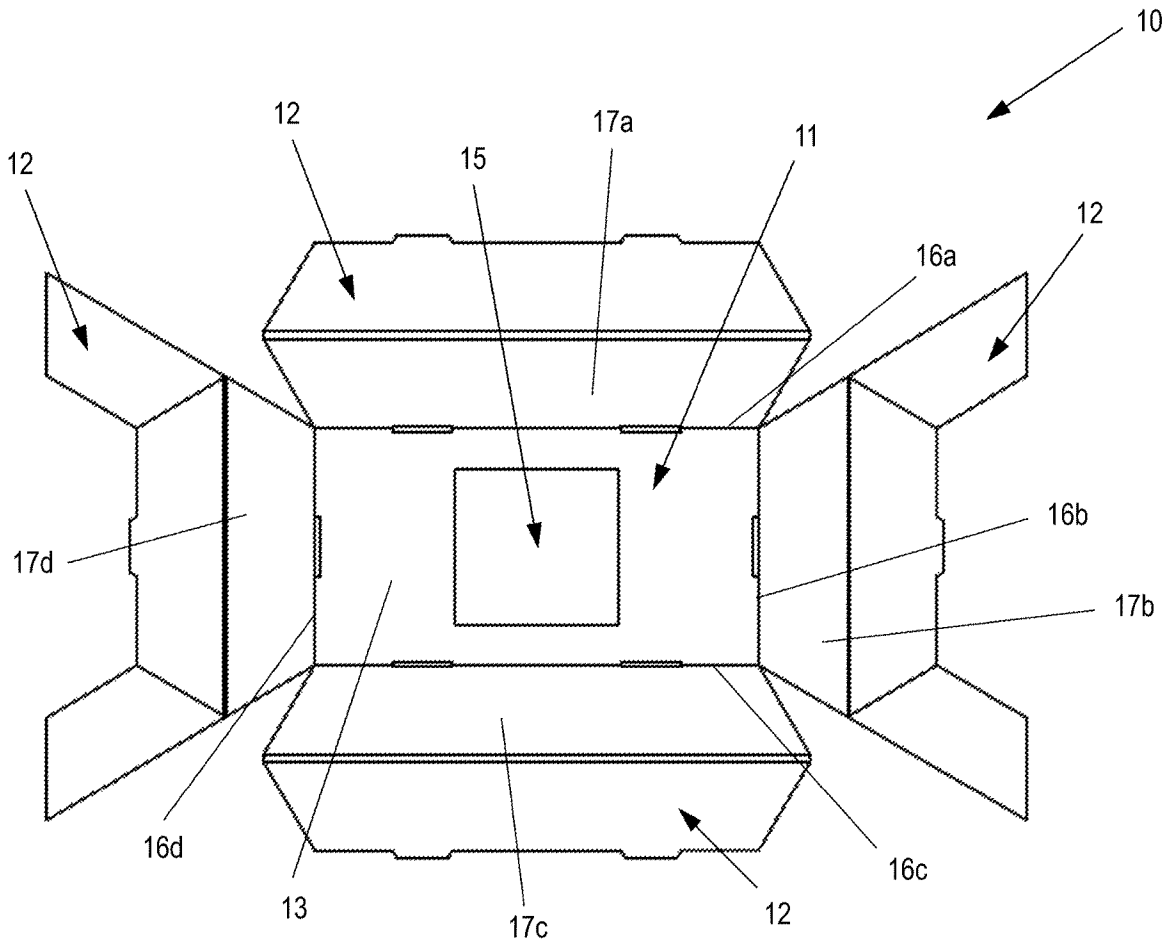
FIG. 8 illustrates a top view of a lap tray of a tray apparatus disposed in a stored configuration according to one example implementation of the present disclosure.

Likewise, as shown in FIG. 8, the lap tray 10 may also be configured as a flat planar surface and/or member when the lap tray 10 is disposed in the stored configuration. In particular, a plurality of lap tray fold lines 16*a*, 16*b*, 16*c*, 16*d* may demarcate raised perimeter edge portions 17*a*, 17*b*, 17*c*, 17*d*, which are configured to form the raised perimeter edge 12, from the flat portion 11 of the lap tray 10. As such, when the lap tray 10 is disposed in a stored configuration, as shown in FIG. 8, the raised perimeter edge portions 17*a*, 17*b*, 17*c*, 17*d* may form a flat planar surface with the flat portion 11 of the lap tray 10. According to some aspects, the lap tray 10 may be configured to fold along the lap tray fold lines 16 so as to provide for transforming the lap tray 10 from the stored configuration to an operating configuration. For example, the lap tray 10 may be configured to fold along the lap tray fold lines 16*a*, 16*b*, 16*c*, 16*d* to form a plurality of raised perimeter edge portions 17*a*, 17*b*, 17*c*, 17*d* configured to operably engage one another to form a continuous raised perimeter edge portion 17 surrounding the flat portion 11 of the lap tray 10. In some aspects, the raised perimeter edge portions 17*a*, 17*b*, 17*c*, 17*d* may be securely affixed to one another with tape, glue, and/or any other suitable adhesive known to one of ordinary skill in the art. In another aspect, raised perimeter edge portions 17*a*, 17*b*, 17*c*, 17*d* may be configured to operably engage one another by folding a first raised perimeter edge portion 17*a* along at least one lap tray fold line 16 while a portion of a second raised perimeter edge portion 17*b* is disposed proximate to the first raised perimeter edge portion 17*a*.

Returning to FIGS. 8 and 9, the lap tray 10 and the tray compartment 20 are illustrated in the stored configuration as a flat planar surface. As such, when disposed in the stored configuration, a lap tray 10A of a first tray apparatus 5A may be configured to operably engage a lap tray 10B of a second tray apparatus 10B when each of the lap trays are disposed in the stored configuration. Additionally or alternatively, operable engagement between lap trays, which are disposed in the stored configuration, may advantageously provide for minimizing the area and/or volumetric space required to store a plurality of lap trays that each correspond to a respective tray apparatus. For example, the flat planar member of each of the plurality of lap trays disposed in the stored configuration may be stacked on pallets, shelves, and/or any other suitable storage mechanism known to one of ordinary skill in the art so as to minimize the vertical height required to store the plurality of lap trays. Likewise, a tray compartment 20A of a first tray apparatus 5A may be configured to operably engage a tray compartment 20B of a second tray apparatus 5B when each of the tray compartments are disposed in the stored configuration. Further, operably engagement between tray compartments, which are each disposed in the stored configuration, of respective tray apparatuses may advantageously provide for minimizing the area and/or volumetric space required to store a plurality of tray compartments that each correspond to a respective tray apparatus.

Figure 13:
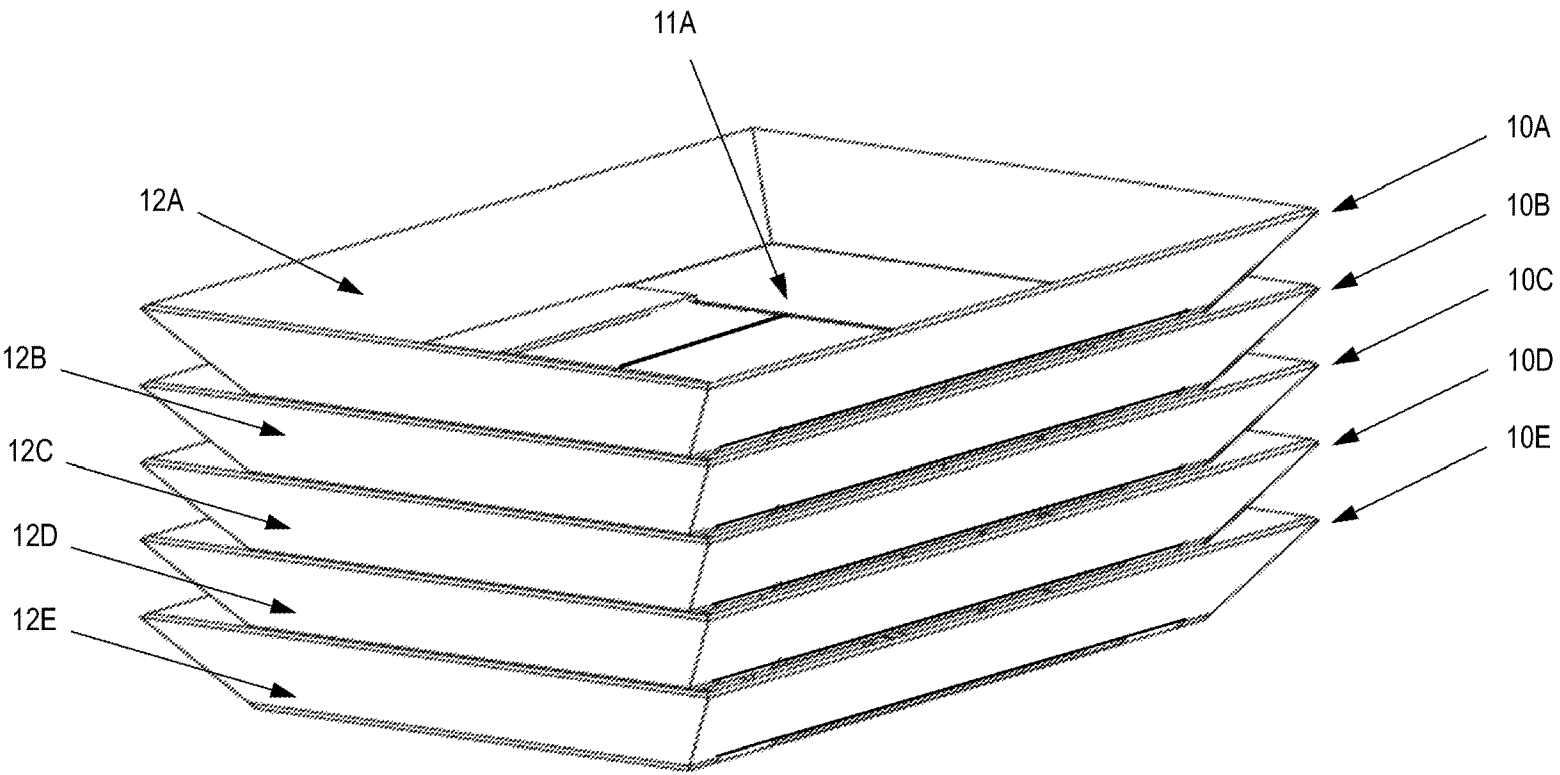
FIG. 13 illustrates a perspective view of a plurality of lap trays of a tray apparatus disposed in an operating configuration and operably engaged with one another according to one example implementation of the present disclosure.

In some aspects, a lap tray 10A, which is disposed in the operating configuration, of a first tray apparatus 5A may be configured to operably engage a lap tray 10B of a second tray apparatus 5B that is also disposed in the operating configuration. Referring to FIG. 13, a plurality of lap trays 10A, 10B, 10C, 10D, 10E disposed in the operating configuration may be configured to operably engage one another. For example, when manipulated from the stored configuration to the operating configuration, a lap tray 10A may be manipulated from a substantially flat planar member to a three-dimensional member that includes a formed raised perimeter edge 12A and a flat portion 11A. As shown in FIG. 13, each of the raised perimeter edges 12A, 12B, 12C, 12D, 12E corresponding to the respective lap trays 10A, 10B, 10C, 10D, 10E may be configured to form a tapered surface when the lap trays are disposed in the operating configuration. Additionally, the tapered surfaces of the respective raised perimeter edges 12A, 12B, 12C, 12D, 12E may advantageously provide for securing the respective lap trays 10A, 10B, 10C, 10D, 10E with one another (e.g., nesting subsequent lap trays within one another in a stacked arrangement) when disposed in the operating configuration.

Figure 14:
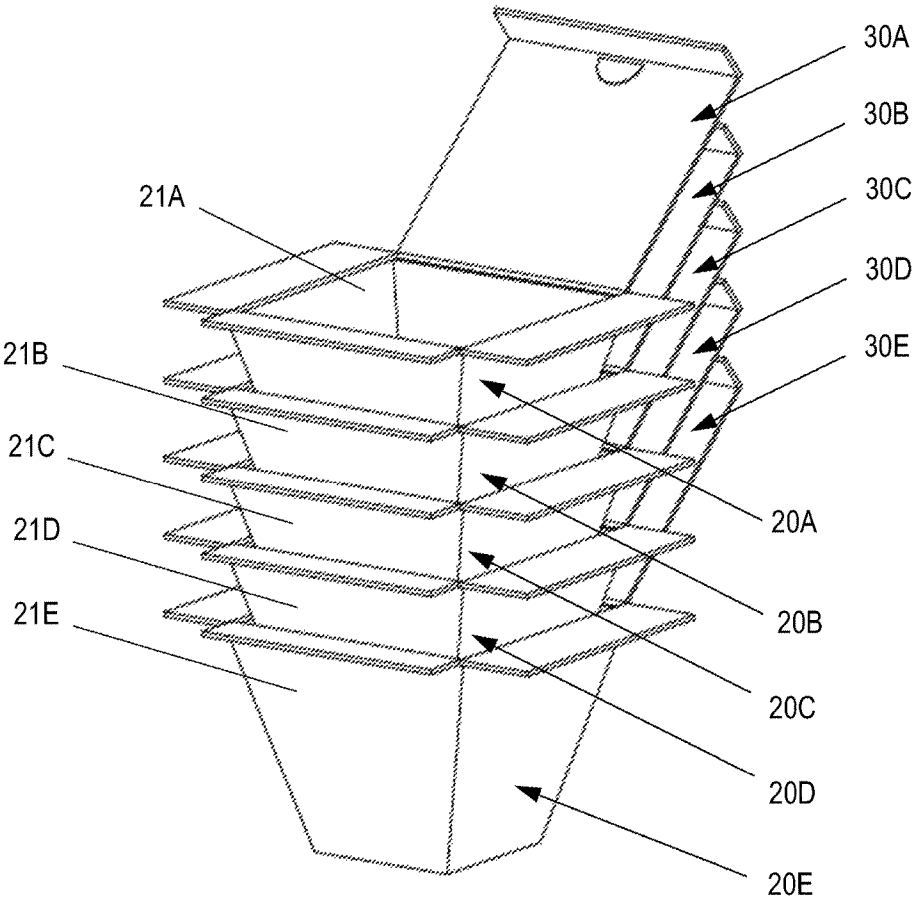
FIG. 14 illustrates a perspective view of a plurality of tray compartments of a tray apparatus disposed in an operating configuration and operably engaged with one another according to one example implementation of the present disclosure.

Likewise, as shown in FIG. 14, a tray compartment 20A, which is disposed in the operating configuration, of a first tray apparatus may be configured to operably engage a subsequent tray compartment 20B, which is disposed in the operating configuration of a second tray apparatus. For example, a plurality of tray compartments 20A, 20B, 20C, 20D, 20E may each be manipulated from a substantially flat planar member, when disposed in the stored configuration, to a three-dimensional member that includes respective sidewalls 21A, 21B, 21C, 21D, 21E and bottom walls (not shown), when disposed in the operating configuration. As shown in FIG. 14, when disposed in the operating configuration, each of the sidewalls 21A, 21B, 21C, 21D, 21E and bottom walls of the respective tray compartments 20A, 20B, 20C, 20D, 20E may be configured to form respective tapered containers configured to provide for securing the respective tray compartments with one another (e.g., nesting subsequent tray compartments within one another in a stacked arrangement) when the tray compartments are disposed in the operating configuration and operably engaged with one another.

Figure 15:
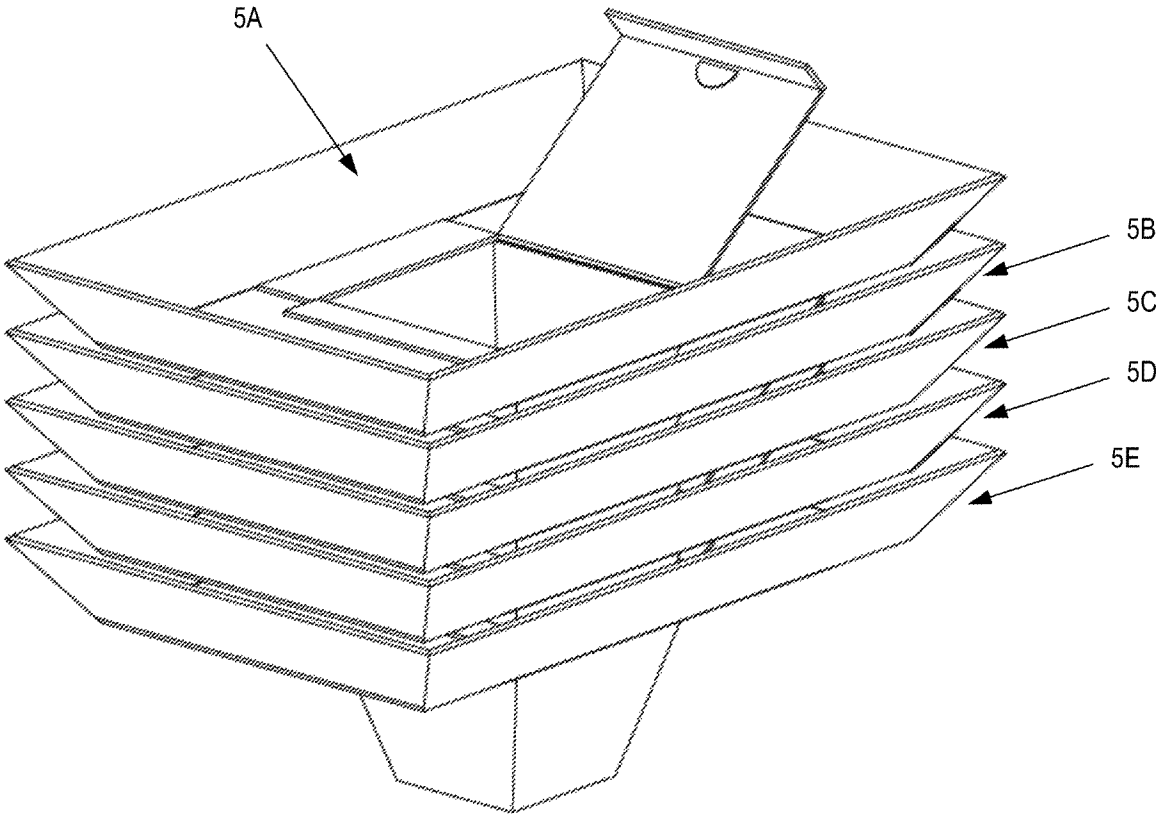
FIG. 15 illustrates a perspective view of a plurality of tray apparatuses operably engaged with one another, each of the tray apparatuses having a lap tray disposed in an operating configuration and a tray compartment disposed in an operating configuration according to one example implementation of the present disclosure.

Referring to FIG. 15, in one aspect of the present disclosure, a plurality of tray apparatuses 5A, 5B, 5C, 5D, 5E may be configured to operably engage one another when each of the tray apparatuses are disposed in the operating configuration. For example, any one of the sidewalls and/or bottom walls of the tray compartment and/or the flat portions and/or raised perimeter edges of the lap tray for a corresponding tray apparatus may be configured to provide for securing the respective tray apparatuses with one another (e.g., nesting subsequent tray apparatuses within one another) when the tray apparatuses are disposed in the operating configuration and are operably engaged with one another.

Figure 16:
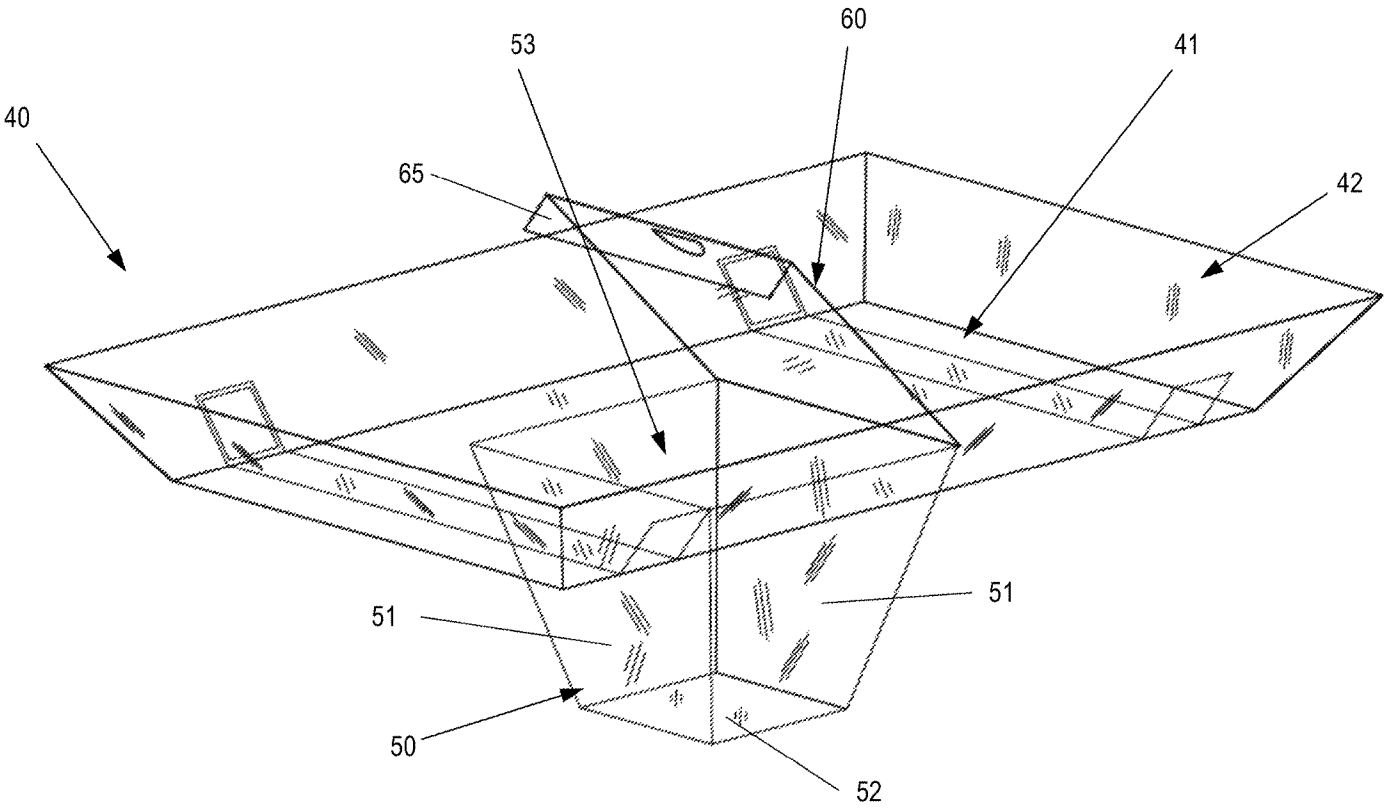
FIG. 16 illustrates a perspective view of a tray liner disposed in an operating configuration according to one example implementation of the present disclosure.
Figure 17:
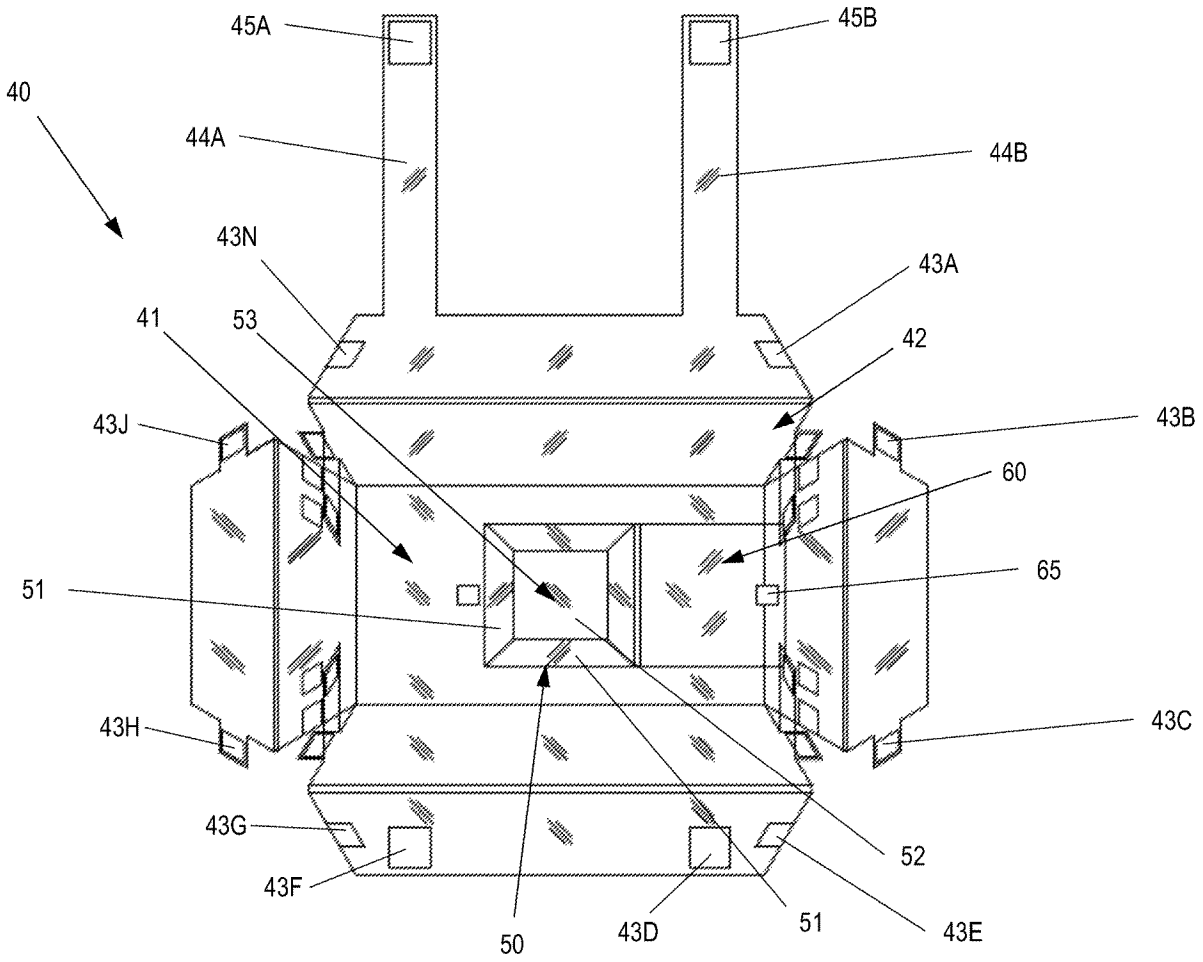
FIG. 17 illustrates a top view of a tray liner disposed in a stored configuration according to one example implementation of the present disclosure.

Referring to FIGS. 16 and 17, according to some aspects of the present disclosure, a tray apparatus may further include a tray liner 40. In particular, FIG. 16 illustrates a tray liner 40 disposed in the operating configuration. FIG. 17 illustrates a tray liner 40 disposed in the stored configuration. According to one example aspect, the tray liner 40 may include a flat tray liner portion 41 and a raised perimeter edge liner portion 42. Additionally, the tray liner 40 may include a tray compartment 50 that has at least one sidewall 51 and a bottom wall 52. According to one aspect, the tray compartment 50 may be integrally formed with the flat tray liner portion 41. In some aspects of the present disclosure, the tray liner 40 may further include a lid 60 configured to enclose an interior space 53, defined in part by the sidewall 51 and the bottom wall 52 of the tray compartment 50 and the lid 60, when the lid 60 operably engages at least a portion of the flat tray liner portion 41. In some aspects, the lid 60 may include a lid securing element 65 configured to reciprocally engage a portion of the flat tray liner portion 41 so as to enclose the interior space 53 of the tray compartment 50. For example, the lid securing element 65 and the portion of the flat tray liner portion 41 reciprocally engaged with the lid securing element 65 may include a temporary adhesive material, a hook and loop fastener, and/or any other material suitable for removably engaging one another. Further, the lid securing element 65 may be configured to reciprocally engage a portion of the flat tray liner portion 41 such that the lid 60 forms a substantially coplanar surface with the flat tray liner portion 41 and may advantageously provide for additional surface area to use while consuming food items. In some aspects, the lid 60 may further define a compartment access element to provide access to the interior space 53 of the tray compartment 50 when the lid securing element 65 is reciprocally engaged with a portion of the flat tray liner portion 41 and encloses the interior space 53 of the tray compartment 50.

In some aspects, the tray liner 40 may include a flexible, yet durable, material configured to be manipulated into a particular shape and/or orientation and maintain said shape and/or orientation. For example, the tray liner 40 may include a polymer material having a thickness suitable so as to retain a desired tray liner shape when a user manipulates the tray liner 40. As shown in FIG. 17, the tray liner 40 may be configured as a substantially flat planar member when the tray liner is disposed in the stored configuration. According to one aspect, the tray compartment 20 may be compressible such that the flat tray liner portion 41, the raised perimeter edge liner portion 42, and/or the tray compartment 20 may collectively form a substantially flat planar member when the tray liner is disposed in the stored configuration.

According to some aspects, the tray liner 40 may include a plurality of tray liner securing elements 43A, 43B, 43C . . . 43N that are configured to reciprocally engage one another so as to secure the tray liner in the operating configuration, as shown in FIG. 16. For example, the tray liner securing elements 43A, 43B, 43C . . . 43N may include a temporary adhesive material, a hook and loop fastener, and/or any other material suitable for reciprocally engaging one another so as to secure the tray liner 40 in the operating configuration.

Figure 18:
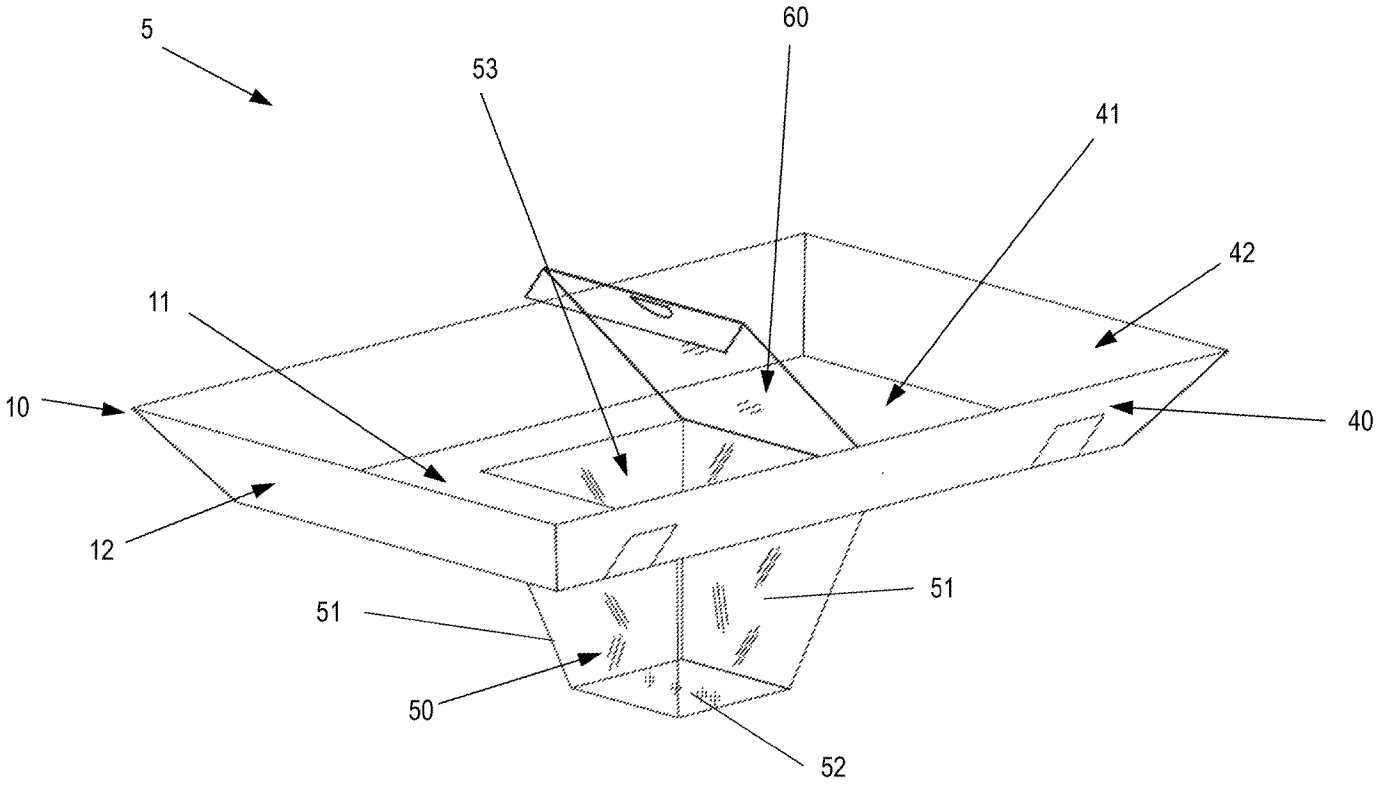
FIG. 18 illustrates a perspective view of a tray liner and a lap tray operably engaged with one another according to one implementation of the present disclosure.

As shown in FIG. 18, the tray liner 40 may be configured to operably engage a respective lap tray 10 when each of the tray liner 40 and lap tray 10 are disposed in the operating configuration. For example, the flat tray liner portion 41 may be operably engaged with the flat portion 11 of a corresponding lap tray 10 so as to provide a protective barrier for the flat portion 11 of the lap tray 10. Additionally or alternatively, a raised perimeter edge liner portion 42 may be operably engaged with the raised perimeter edge 12 of a corresponding lap tray 10 to provide a protective barrier for the raised perimeter edge 12 of the lap tray 10. For example, the flat tray liner portion 41 and/or the raised perimeter edge liner portion 42 may each include a surface that includes an adhesive material configured to temporarily attach the flat tray liner portion 41 and/or the raised perimeter edge liner portion 42 with the respective flat portion 11 and raised perimeter edge 12 of the lap tray 10.

According to another aspect, the tray liner 40 may include at least one tray liner strap member 44A, 44B configured to removeably secure the tray liner 40 to the lap tray 10. In some aspects, a tray liner strap member 44A, 44B may each include a proximal end disposed proximate a first raised perimeter edge liner portion 42A and a respective distal end configured to operably engage at least a portion of a second raised perimeter edge liner portion 42B. The tray liner strap members 44A, 44B may be configured to extend along the bottom surface 14 of the flat portion 11 of the lap tray 10 when the tray liner 40 is operably engaged with the lap tray 10. Additionally, the tray liner strap members 44A, 44B may each include respective a tray liner strap securing element 45A, 45B disposed proximate the respective distal ends of the tray liner strap members. In some aspects, the tray liner strap securing element 45A, 45B may be configured to releasably attach the respective tray liner strap member 44A, 44B with the second raised perimeter edge liner portion 42A.

As previously mentioned, the tray liner 40 may further define a tray compartment 50. The tray compartment 50 may be configured to extend through the aperture 15 defined by the flat portion 11 of the lap tray 10 from the top surface 13 to the bottom surface 14 when the tray liner 40 is operably engaged with the lap tray 10. In particular, the tray compartment 50 may extend downwardly from the flat tray liner portion 41 and through the aperture to form a tray apparatus that is a three dimensional member when disposed in the operating configuration. In some aspects, the tray compartment 50 may be configured to extend through the aperture 15 defined by the flat portion 11 of the lap tray 10 and may be engaged by a portion of the legs of a user disposed in a seated position so as to secure the tray apparatus 5 to the user while in use. In this regard, the tray compartment 50 may include a material that is configured to form a substantially flat planar member with, for example, vertical compression, when disposed in the stored configuration and is also configured to form a three dimensional shaped tray compartment 50 that substantially resists radial compression when disposed in the operating configuration. In yet another aspect, a user may secure the tray apparatus 5 to the user by inserting an object within the tray compartment 50 (e.g., a drink cup) and then subsequently engaging a pliable tray compartment 50, which substantially conforms to the shape of the object inserted within the tray compartment.

Figure 19:
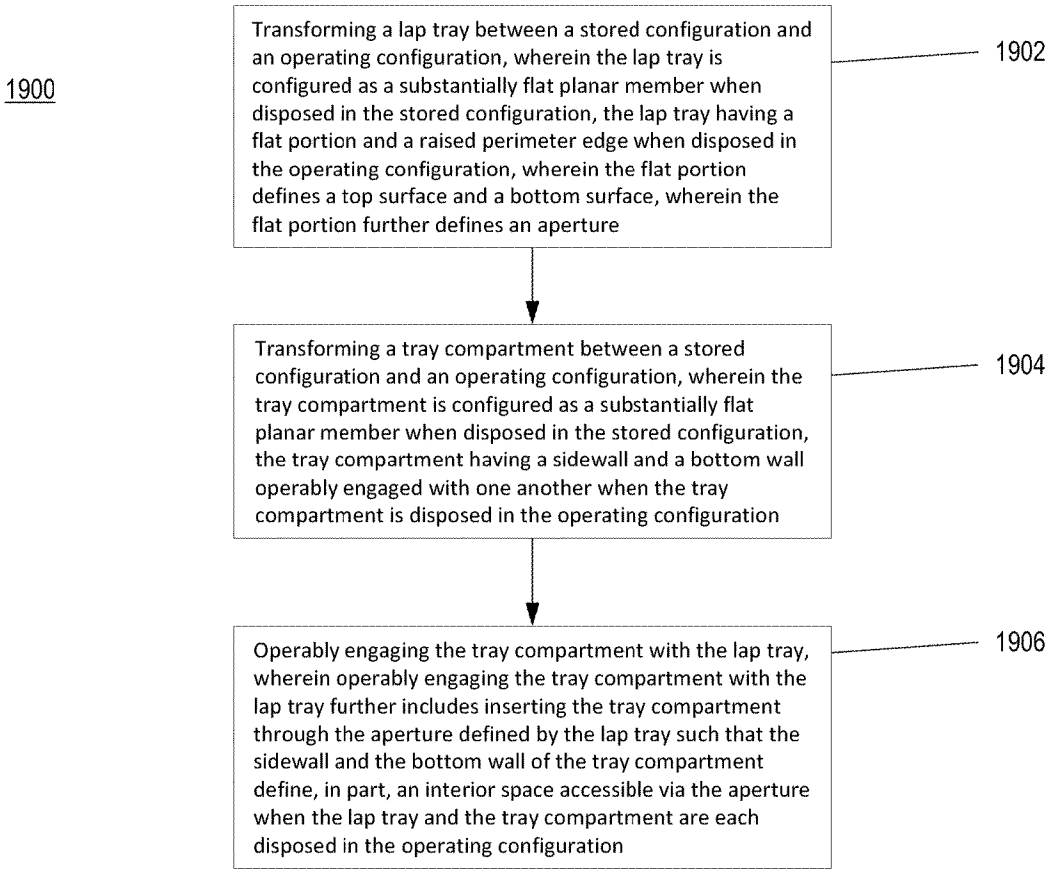
FIG. 19 illustrates a schematic block diagram of a method of using a tray apparatus according to one example implementation of the present disclosure.

One exemplary aspect of the present disclosure provides a method for using a tray apparatus like those previously discussed herein. For example, FIG. 19 illustrates a schematic block diagram of a method 1900 for using a tray apparatus. In some example aspects, the method 1900 may include transforming a lap tray between a stored configuration and an operating configuration 1902. The lap tray may be configured as a substantially flat planar member when disposed in the stored configuration. The lap tray may include a flat portion and a raised perimeter edge and may be configured as a three-dimensional member when disposed in the operating configuration. In some aspects, the flat portion may define a top surface, a bottom surface, and an aperture extending through the flat portion.

In some aspects, the method 1900 may further include transforming a tray compartment 20 between a stored configuration and an operating configuration 1904. The tray compartment may be configured as a substantially flat planar member when disposed in the stored configuration. In another aspect, the tray compartment may be configured as a three-dimensional member and may include a sidewall and a bottom wall that are operably engaged with one another when the tray compartment is disposed in the operating configuration.

According to some aspects, the method 1900 may also include operably engaging the tray compartment with the lap tray 1906. For example, the method may include inserting the formed tray compartment disposed in the operating configuration through the aperture defined by the lap tray such that the sidewall and the bottom wall of the tray compartment define, in part, an interior space accessible via the aperture when the lap tray and the tray compartment are each disposed in the operating configuration.

Many modifications and other implementations of the disclosure set forth herein will come to mind to one skilled in the art to which the disclosure pertains having the benefit of the teachings presented in the foregoing description and the associated drawings. Therefore, it is to be understood that the disclosure is not to be limited to the specific implementations disclosed and that modifications and other implementations are intended to be included within the scope of the appended claims. Moreover, although the foregoing description and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A tray apparatus comprising:

a lap tray having a flat portion and a raised perimeter edge, wherein the flat portion defines a top surface and a bottom surface, wherein the flat portion further defines an aperture;

a tray compartment operably engaged with the lap tray, the tray compartment having a sidewall and a bottom wall, the sidewall and the bottom wall defining, in part, an interior space accessible via the aperture; and a lid operably engaged with the tray compartment, the lid configured to enclose the interior space of the tray compartment, wherein the tray compartment further includes a plurality of tray compartment fold lines, the tray compartment configured to fold along the tray compartment fold lines to form the sidewall and the bottom wall of the tray compartment, wherein the lap tray further includes a plurality of lap tray fold lines, the lap tray configured to fold along the lap tray fold lines to form the flat portion and the raised perimeter edge of the lap tray, wherein the lap tray and the tray compartment are configured to transform from a stored configuration to an operating configuration, the lap tray and the tray compartment configured as flat planar surfaces when disposed in the stored configuration, wherein the lap tray and tray compartment of a first tray apparatus are configured to operably engage a lap tray and a tray compartment of a second tray apparatus while disposed in the operating configuration.

2. The tray apparatus of claim 1, wherein the lid is configured to hingedly connect to an edge of the sidewall of the tray compartment.

3. The tray apparatus of claim 2, wherein the lid further includes a pull tab, the pull tab configured to provide for engaging and disengaging the lid with the tray compartment.

4. The tray apparatus of claim 1, wherein the lid further defines a compartment access element, the compartment access element configured to provide for access to the interior space of the tray compartment when the lid encloses the interior space of the tray compartment.

5. The tray apparatus of claim 1, wherein the lap tray and tray compartment of a first tray apparatus are configured to operably engage a lap tray and a tray compartment of a second tray apparatus while disposed in the stored configuration.

6. The tray apparatus of claim 1, wherein the sidewall of the tray compartment extends downwardly from the flat portion of the lap tray.

7. The tray apparatus of claim 6, wherein the sidewall of the tray compartment is configured to provide for a user to grasp the sidewall of the tray compartment between legs of the user when the user is disposed in a seated position.

8. The tray apparatus of claim 6, wherein the sidewall of the tray compartment extends a distance less than the depth of the legs of the user when the user is disposed in the seated position.

9. The tray apparatus of claim 1 further comprising a tray liner, the tray liner comprising at least one tray liner securing element, and at least one tray liner strap member configured to removeably secure the tray liner to the lap tray and the tray compartment.

10. A tray apparatus comprising:

a lap tray having a flat portion and a raised perimeter edge, wherein the flat portion defines a top surface and a bottom surface, wherein the flat portion further defines an aperture; and a tray liner configured to operably engage the lap tray, the tray liner defining a tray compartment configured to extend through the aperture, the tray liner having at least one tray liner strap member configured to removeably secure the tray liner to the lap tray, wherein the tray liner further defines a flat tray liner portion configured to operably engage the top surface of the lap tray, the tray liner further comprising a lid hingedly attached to the flat tray liner portion and configured to enclose an interior space defined by the tray compartment when operably engaged with the flat tray liner portion, wherein the tray liner includes a material configured to transform the tray liner from a stored configuration to an operating configuration, the tray liner configured as a substantially flat planar member when disposed in the stored configuration, wherein the tray liner further includes at least a pair of tray liner securing elements configured to reciprocally engage one another and releasably secure the tray liner in the operating configuration.

11. The tray apparatus of claim 10, wherein the tray liner is configured as a three dimensional member when disposed in the operating configuration, the tray compartment extending downwardly from the flat tray liner portion.

12. A method for using a tray apparatus, the method comprising:

transforming a lap tray between a stored configuration and an operating configuration, wherein the lap tray is configured as a substantially flat planar member when disposed in the stored configuration, the lap tray having a flat portion and a raised perimeter edge when disposed in the operating configuration, wherein the flat portion defines a top surface and a bottom surface, wherein the flat portion further defines an aperture;

transforming a tray compartment between a stored configuration and an operating configuration, wherein the tray compartment is configured as a substantially flat planar member when disposed in the stored configuration, the tray compartment having a sidewall and a bottom wall operably engaged with one another when the tray compartment is disposed in the operating configuration;

operably engaging the tray compartment with the lap tray, wherein operably engaging the tray compartment with the lap tray further includes inserting the tray compartment through the aperture defined by the lap tray such that the sidewall and the bottom wall of the tray compartment define, in part, an interior space accessible via the aperture when the lap tray and the tray compartment are each disposed in the operating configuration.

* * * * *